US005482182A

United States Patent [19]

Thompson et al.

[11] Patent Number: 5,482,182

[45] Date of Patent: Jan. 9, 1996

[54] TAPE DISPENSER

[75] Inventors: Craig D. Thompson, Inver Grove Heights, Minn.; Robert A. Luhman, Deer Park, Wis.

[73] Assignee: Minnesota Mining and Manufacturing Company, St. Paul, Minn.

[21] Appl. No.: 319,890

[22] Filed: Oct. 7, 1994

Related U.S. Application Data

[63] Continuation-in-part of Ser. No. 138,850, Oct. 18, 1993, abandoned.

[51] Int. Cl.[6] ..... B65H 5/28

[52] U.S. Cl. ..... 221/73; 221/1; 221/185; 156/584; 156/527; 156/DIG. 48

[58] Field of Search ..... 221/70, 69, 72, 221/73, 185, 74, 1; 156/584, 577, 527, 256, 541, DIG. 48

[56] References Cited

U.S. PATENT DOCUMENTS 2,503,741 4/1950 Johnson ..... 221/303

(List continued on next page.)

FOREIGN PATENT DOCUMENTS 2801540 7/1979 Germany ..... B65H 35/06
2196317 4/1988 United Kingdom ..... B65H 37/00

OTHER PUBLICATIONS 3M brochure number 44–0009–1811–8(A82.1)R1, 3M Industrial Tape and Specialties Division, Specifications, Scotch™ S–625 Pad Applicator Model 59100.

3M brochure number 34–7004–7297–9(B67.1)R1, 3M Industrial Specialties Division, Instructions and Parts List, Scotch™, P/N 78–8028–8075–3 Liner Removal Attachment.

3M brochure number 34–7004–7383–7(E52.15)R1, 3M Identification and Converter Systems Division, Instructions and Parts List, Scotch™, LS–52 and LS–56 Label Dispensers Model 18600.

3M brochure number 34–7004–7047–8(B47.15)R1 BL, 3M Converter Specialties Division, Instructions and Parts List, Scotch™ LS–8 Manual Label Dispenser Model 17000.

3M brochure number 34–7004–7124–5(B98.1)R1, 3M Converter Specialties Division, Instructions and Parts List, Scotch™ LS–2 Label Dispenser Model 16100.

3M brochure number 70–0702–7574–1, 3M Converter Specialties Division, ScotchMark™ 1504–DR5 and 1504–D3 Diskette Labeling Systems.

3M brochure number 34–7004–7058–5(E57.55)R2, Tape Dispenser Products, Instructions and Parts List Cat. No. LH–54 Manual Label Dispenser Type 27400.

3M brochure number 44–0009–1823–3(A33.1)R1, Tape Dispenser Products, Instructions and Parts List Cat. No. LH–31 Electric Label Dispenser Type 39300.

*Primary Examiner*—H. Grant Skaggs
*Attorney, Agent, or Firm*—Gary L. Griswold; Walter N. Kirn; Mark W. Binder

[57] ABSTRACT

The invention relates to a portable dual advance dispenser for a supply of linered tape material having an adhesive tape mounted in separable strips on a release liner. The dispenser includes a frame for supporting a supply of linered tape material and a dispensing apparatus for dispensing desired portions of the linered tape. The dispensing apparatus includes a rotatable liner dispensing member which directs a portion of the liner in a different direction from the adhesive tape, a rotatable adhesive tape material dispensing apparatus for dispensing the adhesive tape, a separation member to separate the liner from the adhesive tape, and a drive transfer mechanism which causes interaction between the rotatable adhesive tape material dispensing apparatus and the rotatable liner dispensing member. If the user selects a first dispensing option, adhesive tape is pulled from the adhesive tape dispensing apparatus, and the liner is advanced through the liner dispensing apparatus. If the user selects a second dispensing option, then the liner is pulled from the liner dispenser apparatus, and the adhesive tape is advanced through the adhesive tape dispensing apparatus. The linered tape may be dispensed by grasping either the liner or the adhesive tape.

20 Claims, 2 Drawing Sheets

U.S. PATENT DOCUMENTS

| | | | |
|---|---|---|---|
| 2,569,140 | 9/1951 | Avery | 156/536 |
| 2,808,962 | 10/1957 | Warmath | 221/34 |
| 2,912,140 | 11/1959 | Cole | 221/70 |
| 3,283,886 | 11/1966 | Addis et al. | 242/588.6 |
| 3,468,743 | 9/1969 | Soriano | 156/584 |
| 3,653,539 | 4/1972 | Stageberg | 221/73 |
| 3,987,931 | 10/1976 | Fell et al. | 221/73 |
| 3,992,244 | 11/1976 | Craig et al. | 156/521 |
| 4,240,867 | 12/1980 | Diegel | 156/543 |
| 4,488,925 | 12/1984 | Craig et al. | 156/351 |
| 4,515,288 | 5/1985 | Atalla | 221/73 |
| 4,813,571 | 3/1989 | Slagter | 221/13 |
| 5,009,739 | 4/1991 | Goodwin et al. | 156/384 |

TAPE DISPENSER

This is a continuation-in-part of the application Ser. No. 08/138,850, filed Oct. 18, 1993, now abandoned.

FIELD OF THE INVENTION

The present invention relates to a manual dispenser for dispensing strips of adhesive tape. In particular, the invention relates to a belt dispenser used to manually dispense discrete lengths of adhesive tape from a roll.

BACKGROUND OF THE INVENTION

Manual dispensers have been used for the convenient separation and removal of a tape, label, or other product from a release liner placed over the adhesive surface of the tape, label, or other product. For instance, manual label dispensers may be used to separate the desired label from a liner material. The labels are typically dispensed by pulling the liner that is threaded around a peel plate. The peel plate separates the label from the liner. The label is suspended in air, and is removed by the user. These machines may be automated such that: the feed automatically stops when the label is dispensed. An example of a manual label dispenser is U.S. Pat. No. 4,813,571, issued to Slagter.

Another method used to separate a liner material from a tape uses a mechanism known as a plow. The plow mechanism is a type of sharp blade. The tape is advanced to the plow mechanism on the applicator or dispenser and the plow mechanism peels the liner from the tape. The user pulls the tape rather than the liner to separate the liner and the tape. If the liner is pulled, the tape remains stuck to the liner.

One example of a situation where a user needs to dispense adhesive tape to apply to an object has arisen in the United States where the National Highway Traffic Safety Administration issued a conspicuity rule requiring trailers that exceed certain width and weight restrictions that were built on or after Dec. 1, 1993, to be equipped with retroreflective sheeting or reflex reflectors. The basic requirement of the conspicuity rule as applied to truck trailers requires that reflective sheeting be applied in a pattern of alternating white and red color segments to the side and rear of the trailer, and in white only to the upper rear corners of the trailer.

The rear reflective markings include a horizontal stripe in alternating colors across the full width of the trailer as close to the edges and as close to 1.25 meters (approximately 4 feet 1 inch) from the road surface as practicable. In addition, two pairs of white sheeting strips applied horizontally and vertically to the right and left upper contours of the trailer body as close to the top and as far apart as possible are required. A strip of sheeting in alternating colors across the full width of the rear underride protection device is also required.

The side reflective sheeting includes a horizontal strip in alternating colors originating and terminating as close to the front and rear ends and as close to 1.25 meters above the road surface as practicable. In addition, reflex reflectors will be installed in the same locations and in the same length as the retroreflective sheeting using a pattern of two or three white reflectors alternating with two or three red reflectors.

Applying lengths of tape to truck trailers as described above can be difficult and time consuming when appropriate tape dispensing tools are not provided. In addition to tape application to truck trailers, there are various other situations in the tape application industry where it would be advantageous for users of linered tape products to have portable, manually operated tape dispensers which facilitate easy tape dispensing.

SUMMARY OF THE INVENTION

The present invention addresses the shortcomings and disadvantages of the prior art dispensers by providing a portable, manually operated dispenser that is easier to use than prior art dispensers because it allows the operator to pull either the adhesive tape or the liner of a linered tape product to dispense the tape. Specifically, the invention relates to a portable dual advance dispenser for a supply of linered tape comprising a plurality of separable adhesive tape strips mounted on a release liner. As used herein, the term dual advance means that either the liner or the adhesive tape may be pulled to dispense the tape product.

The dispenser includes a frame for supporting a supply of linered tape and dispensing means for dispensing desired portions of adhesive tape and liner. The dispensing means includes a rotatable liner dispensing means which directs a portion of the liner in a different direction from the adhesive tape and a rotatable adhesive tape dispensing means positioned adjacent the rotatable liner dispensing means. A separation member proximate the rotatable adhesive tape dispensing means and the rotatable liner dispensing means is used to separate the liner from the adhesive tape. A drive transfer means is provided between the rotatable adhesive tape dispensing means and the rotatable liner dispensing means so that rotating one of the dispensing means causes the other of the dispensing means to rotate. If the user selects a first dispensing option, adhesive tape is pulled from the rotatable adhesive tape dispensing means, and the drive transfer means causes the liner to advance through the rotatable liner dispensing means. If the user selects a second dispensing option, then the rotatable liner is pulled from the rotatable liner dispenser means, and the drive transfer means causes the adhesive tape to advance through the rotatable adhesive tape dispensing means. Advantageously, the linered tape may be dispensed by grasping either the liner or the adhesive tape. Preferably, one of the dispenser means is driven faster than the other dispenser means for improved performance.

The invention also relates to a dispenser for manually dispensing a linered tape comprising an adhesive tape layer and a liner from a supply. The dispenser includes a tape support provided on the dispenser to hold the supply of linered tape. The dispenser also includes a separation means provided on the dispenser which separates the linered tape into the adhesive tape and the liner. A tape guide means adjacent the separation means is used to receive the separated adhesive tape. The dispenser also includes a guide means for guiding the adhesive tape over the tape guide means. A liner advancing means adjacent the tape guide means is used to receive the separated liner. An interaction means is provided between the tape guide means and the liner advancing means so that when the tape guide means or the liner advancing means is activated, the other of the tape guide means or the liner advancing means is activated. The extending adhesive backed tape may be pulled by a user to dispense the tape, thereby advancing the liner through the liner advancing means. Alternatively, if the liner is grasped by the user, the adhesive tape is advanced over the tape guide means. Preferably, one of the dispenser means is driven faster than the other dispenser means for improved performance.

The invention also relates to a method for manually dispensing linered tape from a dispenser. A supply of linered tape is provided, where the linered tape is made up of separable adhesive tape strips mounted on a release liner. The adhesive tape is then separated from the liner and the liner is threaded through a liner advancing member. The adhesive tape is directed to the adhesive tape dispensing member which interacts with the liner advancing member through a drive transfer means. Then the liner is pulled to advance the adhesive tape partially through the adhesive tape dispensing member by way of the drive transfer means so that the tape extends beyond the tape dispensing member and the liner extends beyond the liner dispensing member. Either the liner or the adhesive tape is then pulled to dispense the tape.

DETAILED DESCRIPTION OF THE PREFERRED EMBODIMENT

The invention relates to a manual tape applicator or dispenser which is preferably suitable to be worn on the body of a user. In one preferred embodiment, the invention relates to a portable, belt-mounted, dual advance manual tape applicator or dispenser worn around the waist of the user which dispenses separable (i.e., pre-cut, including die cut and butt-cut, or weakened, including perforated) lengths of linered tape. However, it is to be understood that the dispenser of the present invention need not be mounted on a belt to be functional. As used throughout this application, the term linered tape is preferably meant to include any adhesive tape mounted on a release liner, including reflective sheeting, film tape, foam-backed tape, labels, decals, decorative striping, and the like. In addition, the term dual advance means that feeding the linered tape through the applicator can be accomplished by either pulling the liner, pulling the adhesive tape itself, or by pulling the liner and adhesive tape at the same time. The dispenser is used to strip liner from the linered tape and dispense lengths of adhesive tape so that they can be easily grasped by the user.

Figure 1:
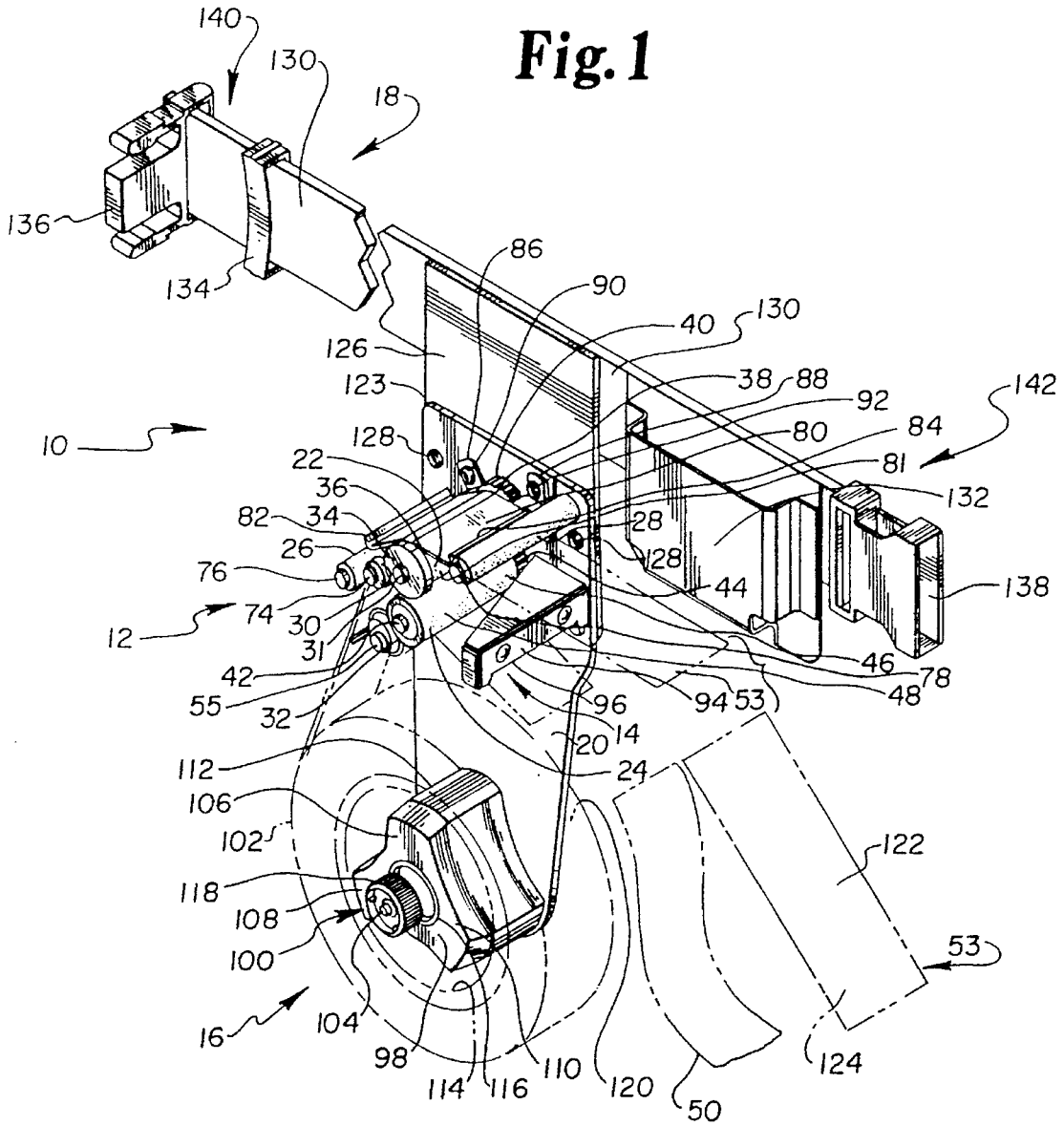
FIG. 1 is a perspective view of the manual belt dispenser of the present invention with parts illustrated in phantom-line.
Figure 2:
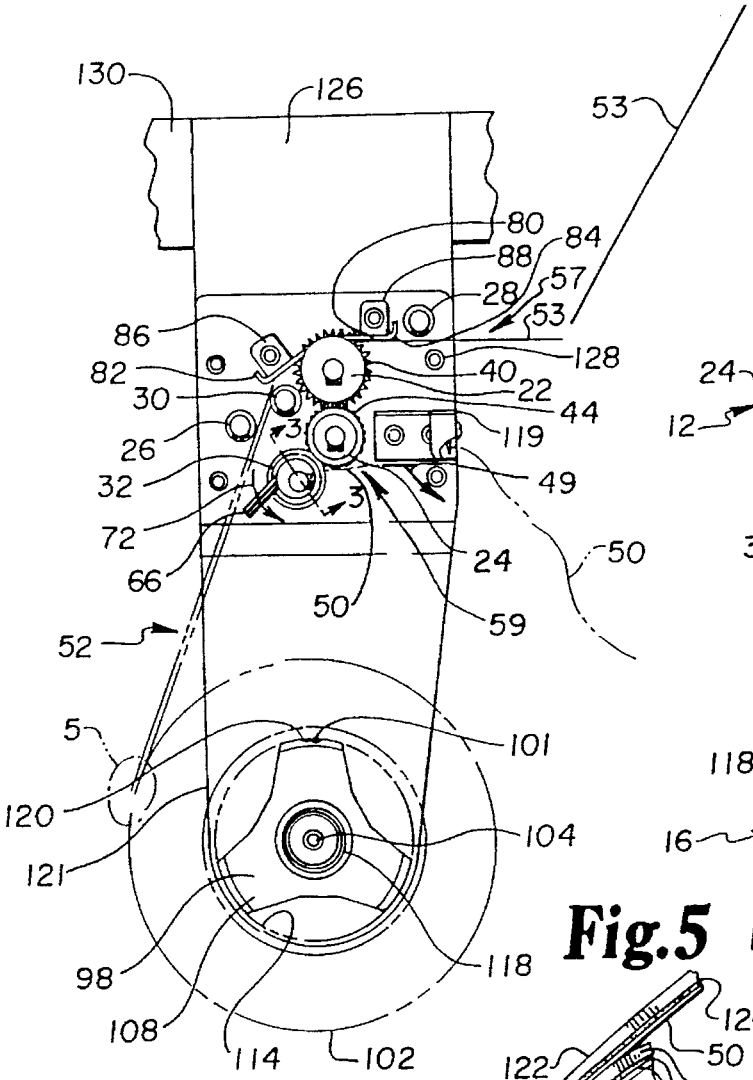
FIG. 2 is a front elevational view of the belt dispenser illustrated in FIG. 1.

Referring to FIGS. 1 and 2, a perspective view and a front elevational view, respectively, of the tape belt applicator or dispenser 10 for linered tapes 52 are illustrated. Tape dispenser 10 may be used to dispense reflective sheeting for manual application to a vehicle or other end use, and may also be used to dispense other types of products. Tape belt dispenser 10 generally comprises dispensing assembly 12, blade assembly 14, tape drum assembly 16, belt assembly 18, and elongate mounting frame 20.

As illustrated in FIGS. 1 and 2, dispensing assembly 12 is positioned proximate one end of a mounting frame 20. Dispensing assembly 12 generally comprises a knurled tape drive roller 22, a liner roller 24, idler rollers 26 and 28, a peel roller 30, and a pinch roller 32. The tape roller 22 is mounted on a spindle or shaft 31 that is affixed at one end to mounting frame 20. Tape roller 22 may freely rotate on shaft 31, preferably in a clockwise direction. Tape roller 22 may optionally include a one-way clutch (not shown) which prevents back up of liner 50 in dispenser 10 and prevents counterclockwise rotation of tape roller 22. Guide flange 34 is positioned at end 36 of tape roller 22, so that shaft 31 extends through guide flange 34. Guide flange 34 restricts movement of adhesive tape 53 laterally, i.e., axially relative to shaft 31 and tape roller 22, and prevents slippage of adhesive tape 53 from tape roller 22. End 38 of tape roller 22 is rotatably connected to gear 40 adjacent mounting frame 20. Tape roller 22 may vary in dimensions.

Liner roller 24 is spaced from and positioned adjacent to tape roller 22. Liner roller 24 is mounted on spindle or shaft 42 that is affixed at one end to mounting frame 20. Liner roller 24 may freely rotate on shaft 42, preferably in a counterclockwise direction. Liner roller 24 may optionally include a one way clutch (not shown) which prevents clockwise rotation of liner roller 24 and prevents back-up of liner 50 in dispenser 10. Liner roller 24 is rotatably attached to gear 44 at end 46 of liner roller 24 adjacent mounting frame 20. Gear 44 meshes with gear 40 that is connected to tape roller 22. Shaft 42 extends through liner roller 24. Liner roller 24 preferably includes an outer sheath 48 comprising an elastomeric material, such as rubber or the like, to improve traction with release liner 50. However, it is also contemplated that liner roller 24 has no outer sheath or that the liner roller 24 itself is constructed of a material that facilitates friction between the liner roller 24 and the release liner 50. Liner roller 24 may vary in dimensions as desired.

Surface velocity of liner roller 24 is preferably greater than the surface velocity of tape roller 22 for enhanced performance of the dispenser. Adhesive tape 53 is fed past peel roller 30, tape guide 80, and tape roller 22 by pulling liner 50 in the direction shown by arrow 49 in FIG. 2. The relationship between the surface velocity ($V_L$) of liner roller 24 and the surface velocity ($V_T$) of tape roller 22 is determined (when using a gear drive transfer mechanism) by the product of the ratio of the number of teeth on gears 40, 44 and the ratio of the diameters of liner roller 24 and tape roller 22, as set forth in the equation at I below.

$$\frac{V_L}{V_T} = \frac{N_T}{N_L} \times \frac{D_L}{D_T} \qquad \text{(I)}$$

In the above equation, $N_T$ is the number of teeth on tape feed gear 40, $N_L$ is the number of teeth on liner feed gear 44, $D_T$ is the diameter of tape roller 22, $D_L$ is the diameter of liner roller 24. A preferred ratio of the surface velocity ($V_L$) of liner roller 24 to the surface velocity ($V_T$) of tape roller 22 is greater than 1:1, and more preferably, the ratio is about 1.5:1.

Other drive transfer mechanisms are contemplated, including mechanical mechanisms such as chains and sprockets, pulleys, belts, and the like, and both electrical and electromechanical systems. In any case, it is preferred that the above ratios are utilized.

Figure 3:
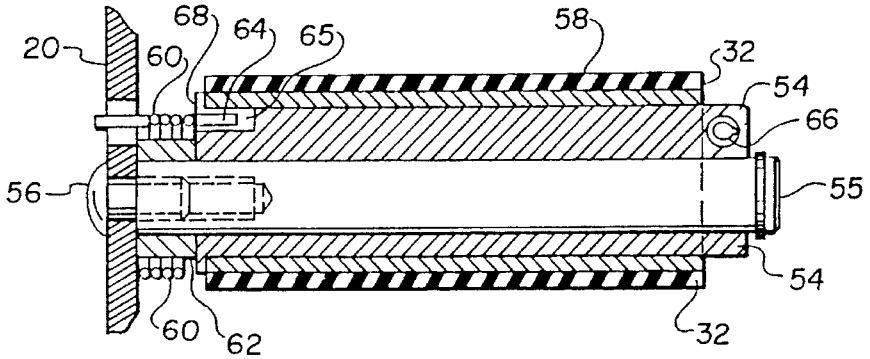
FIG. 3 is a fragmentary section taken along line 3—3 in FIG. 2 of the pinch roller.

Pinch roller 32 is positioned adjacent liner roller 24. Referring to FIGS. 1, 2 and 3, pinch roller 32 is shown in more detail. Pinch roller 32 is rotatably mounted to an over center, eccentric spindle or shaft 54. Shaft 55 is fixedly attached at one end to mounting frame 20 by a suitable fastening member 56, such as a button head screw which is threaded into shaft 55. Pinch roller 32 may freely rotate on shaft 54. Pinch roller 32 preferably also includes an optional outer sheath 58. Outer sheath 58 may comprise an elastomeric material, such as rubber, to improve traction with the liner 50 on linered tape 52 but may comprise any known roll coverings that would facilitate traction between the pinch roller 32 and the liner 50 on linered tape 52. Resilient biasing means is provided for loading eccentric shaft 54 onto frame 20. Resilient biasing means may, in one embodiment, comprise a spring 60 which is positioned around spacer 62, between eccentric shaft 54 and mounting frame 20. In this embodiment, spring 60 is preferably a torsion spring. Spring 60 is attached to eccentric shaft 54 by inserting end 64 of spring 60 into aperture 65 in shaft 54. Pin 66 and related flange 68 securely attach pinch roller 32 to shaft 54. Pinch roller 32 may vary in dimensions.

Pin 66 on eccentric shaft 54 is used to rotate pinch roller 32 to an opened position, as indicated by arrow 72 in FIG. 2, such that the resilient biasing means is compressed or wound tighter and eccentric shaft 54 is rotated counter clockwise. Pin 66 is used to place pinch roller 32 in an open position to insert liner 50 between pinch roller 32 and liner roller 24 as liner 50 is fed through belt dispenser 10. After release of pin 66, the resilient biasing means, in this embodiment, torsion spring 60, biases pinch roller 32 to a nipped position against liner roller 24, as shown in FIG. 2. The nip should be enough to drive liner 50 through dispenser 10, while maintaining slip between liner 50 and liner roller 24, so that the surface speed of liner roller 24 is always slipping. It is recognized that other resiliently biased pinch roller designs may be used within this invention to create an appropriate nip between the pinch roller and the liner roller and providing ergonomic feed means for feeding a liner through the respective rollers.

Peel roller 30 is preferably positioned adjacent to and generally between the tape roller 22 and liner roller 24. Shaft 74 is attached at one end to mounting frame 20. Peel roller 30 is rotatably mounted to and positioned around shaft 74. Peel roller 30 may freely rotate around shaft 74. Alternatively, a stationary edge or bar (not shown) may be used instead of peel roller 30. Linered tape 52 is separated by peel roller 30, such that adhesive tape 53 is advanced toward tape roller 22, and liner 50 is directed toward liner roller 24. Separation of liner 50 from linered tape 52 occurs because peel roller 30 defines an abrupt change in direction between a first path portion 57 of adhesive tape 53 and a second path portion 59 of liner 50. In addition, the adhesive tape 53 is normally a stiffer material than liner 50, which encourages adhesive tape 53 to proceed on a different path or in a different direction than liner 50. However, it is also contemplated that the adhesive tape 53 and liner 50 are equal in stiffness or that the liner 50 is a stiffer material than the adhesive tape 53, as long as the adhesive tape 53 is sufficiently stiff. Peel roller 30 or stationary edge may vary in dimensions, but should be small enough in diameter to achieve the change in path direction of adhesive tape 53 and liner 50.

Idler rollers 26, 28 are positioned adjacent peel roller 30 and tape roller 22, respectively. Idler rollers 26, 28 are rotatably positioned on shafts 76, 78, and may freely rotate around shafts 76, 78 in a clockwise or counter clockwise direction. Idler rollers are utilized to guide linered tape 52 and adhesive tape 53 during dispensing. Idler rollers 26, 28 may vary in dimensions. Moreover, additional idler rollers and/or different locations of the idler rollers 26,28 to guide the linered tape 52 and adhesive tape 53 are contemplated by the present invention.

Tape guide 80 is positioned adjacent tape roller 22. Ends 82, 84 of tape guide 80 extend adjacent peel roller 30 and idler roller 28, respectively. Preferably, tape guide 80 is made of a durable material and may be variously configured to direct adhesive tape 53 around tape roller 22. Tape guide 80 is configured so as not to interfere with gear 40. Tape guide 80 is securely attached to mounting frame 20 by flanges 86, 88 and fastening members 90, 92 or other suitable means. Tape guide 80 directs the adhesive tape 53 from peel roller 30, where liner 50 has been removed, toward idler roller 28 for dispensing of the adhesive tape 53 by the user. A space 81 is provided between tape guide 80 and tape roller 22 to allow adhesive tape 53 to be positioned over tape roller 22, as best seen in FIG. 1. Adhesive tape 53 is fed past peel roller 30, tape roller 22, and tape guide 80 by pulling liner 50 in the direction shown by arrow 49 in FIG. 2.

Blade assembly 14 is securely attached to mounting frame 20. Blade assembly 14 includes housing 94, cutting blade 96, and blade clamp 97 (not shown) which pinches or holds blade 96 in place. Cutting assembly 14 is positioned adjacent liner roller 24. Cutting assembly 14 is used to easily cut any excess length of liner 50 which was separated from linered tape 52.

Referring to FIGS. 1 and 2, tape drum assembly 16 is shown in more detail. Tape drum assembly 16 comprises hub 98, compression spring drag system 100, and tape supply roll 102, shown in phantom mounted on hub 98 of tape drum assembly 16. Hub 98 is positioned on axle 104. Axle 104 is attached at one end to mounting frame 20. Hub 98 may be made of any durable material such as plastic, metal, or other conventional durable substance, and the hub may comprise a variety of shapes, other than the three prong structure shown in FIGS. 1 and 2. Prongs 106, 108, 110 may include gripping grooves or channels 112 to firmly grasp the inner core 114 of tape supply roll 102. The number of grooves 112 may vary on each prong 106, 108, 110.

Compression spring drag system 100 generally comprises a compression spring 116 and a knob 118. Knob 118 is used to adjust the tension of compression spring 116 to adjust the unwind tension of linered tape 52. It is recognized that other means for controlling unwind tension may be used within the scope of this invention. However, the preferred embodiment is ergonomically optimized with advantage for the user.

Figure 4:
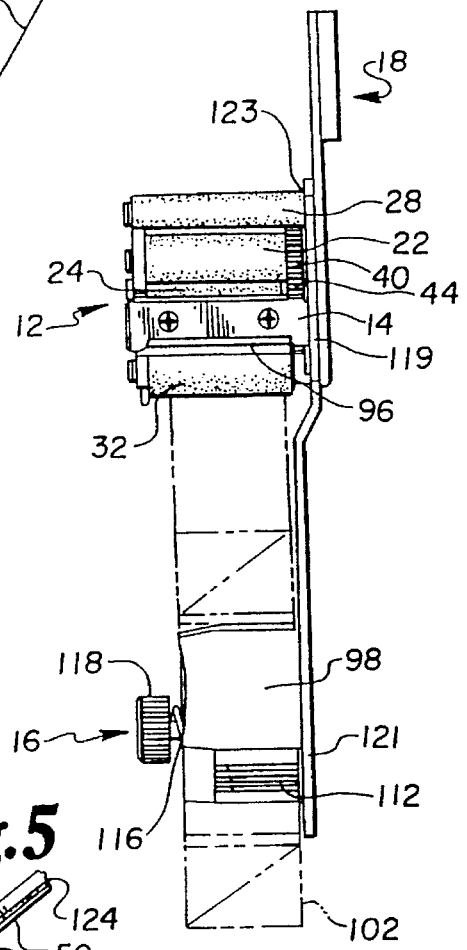
FIG. 4 is a side elevational view of the belt dispenser illustrated in FIG. 1.

In FIG. 4, a side elevational view of belt dispenser 10 discloses dispensing assembly 12 components including pinch roller 32, tape roller 22, liner roller 24, and idler roller 28 mounted on mounting frame 20 of belt applicator or dispenser 10. Gear 40 of tape roller 22 engages with gear 44 of liner roller 24. Cutting blade assembly 14 is secured to side 119 of mounting frame 20 to conveniently cut lengths of liner 50. Tape drum assembly 16 is positioned at end 121 of mounting frame 20. Compression spring 116 and knob 118 extend from tape drum assembly 16. Belt assembly 18 is attached to frame 20 proximate end 123 of mounting frame 20.

Tape supply roll 102 is positioned on hub 98 such that end surface region 120 of supply roll 102 is positioned against flanges 101 on hub 98. Inner core 114 of tape supply roll 102 is securely engaged by the region of grooves 112 of hub 98.

Linered tape 52 is separable into plural strips and is preferably butt-cut, die cut, or perforated in desired successive lengths. The terms butt-cut and die cut mean that all layers of the linered tape 52 are not completely severed when the roll is being manufactured. Rather, only the adhesive tape 53 of the linered tape 52 is severed, while the liner 50 remains a unitary sheet until it is cut by the user. The adhesive tape 53 may be butt-cut, die cut or perforated in varying lengths for application to particular objects, such as the approximate one foot lengths of reflective tape needed for application to truck trailers to comply with the National Highway Traffic Safety Administration conspicuity rule. The width of linered tape 52 may vary. Linered tape 52 may be colored, or may be stored on supply roll 102 in alternating color arrangements to comply, for instance, with the conspicuity rule. Linered tape 52 may also include label stock, which is typically made using a die cutting process, or other adhesive tape products. It is also contemplated that the dispenser of the present invention may be used for those die cut labels where a portion of the adhesive tape 53 remains mounted on the liner 50 after the labels are removed. In this case, the portion of the adhesive tape 53 that remains on the liner 50 after the label is removed will be proceed with the liner 50 toward liner roller 24.

Figure 5:
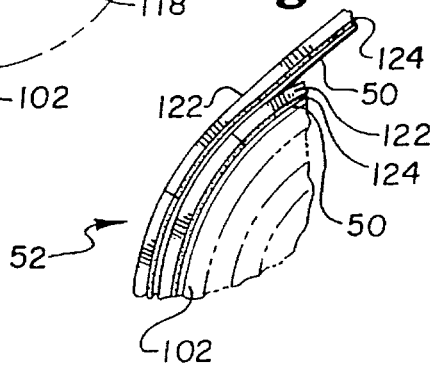
FIG. 5 is a fragmentary view taken from the area encircled at 5 in FIG. 2.

As shown in FIG. 5, an example of a tape supply roll 102 is shown in more detail. Linered tape 52 comprises a top layer 122 such as film, sheeting with a retroreflective surface, paper, or the like. Linered tape 52 also preferably comprises a pressure sensitive adhesive layer 124 mounted to one side of the top layer 122. A release liner 50 is positioned against adhesive layer 124 as another layer of the linered tape 52. It is recognized that other embodiments of tape construction may be used within the scope of this invention as conventionally known in the art, such as a tape with adhesive on both sides of a base layer and a liner covering both adhesive layers.

Again, it is to be understood that the dispenser of the present invention is preferably mounted on a belt, but need not be mounted on a belt to be functional. Referring again to FIG. 1, belt assembly 18 is shown in more detail. Belt hanger 126 is secured to mounting frame 20 by a fastening member, such as rivets 128 or other suitable fastening means. Belt hanger 126 is securely attached to waist belt 130. Belt assembly 18 may include pockets or pouches for the convenience of the user, such as utility pouch 132. Waist belt 130 may include a slide 134 for receiving a part of waist belt 130. A male slide buckle 136, and a female slide buckle 138, or other conventionally known fastening means, are positioned on ends 140, 142 of waist belt 130 for attaching tape belt dispenser 10 around the torso of the user.

In operation of the illustrated embodiment, supply roll 102 of linered tape 52 is positioned over hub 98 so that it rests against flanges 101 on hub 98. Compression spring 116 is adjusted as necessary to maintain enough unwind tension of supply roll 102 to prevent over-coasting of tape supply roll 102 during the dispensing operation. Leading end of tape supply roll 102 is unrolled and directed toward dispensing assembly 12. As shown best in FIG. 2, linered tape 52 is guided through dispensing assembly 12. Linered tape 52 is threaded past idler roller 26 toward peel roller 30.

Liner 50 is fed past peel roller 30, and is guided toward liner roller 24 and pinch roller 32. Pin 66 is rotated in the direction of arrow 72, shown in FIG. 2, so that torsion spring 60 is wound tighter. As a result, pinch roller 32 is rotated into an open, threading position, and is separated from liner roller 24 to create a space between liner roller 24 and pinch roller 32. Pinch roller 32 in an open position permits easy and convenient threading of liner 50 between liner roller 24 and pinch roller 32. After liner 50 has been threaded between liner roller 24 and pinch roller 32, pin 66 is released, and pinch roller 32 returns to a nipped operating position abutting liner roller 24, as shown in FIGS. 1 and 2. Liner 50 is directed toward cutting assembly 14, as shown in FIGS. 1 and 2. As liner 50 is pulled toward cutting assembly 14, adhesive tape 53 is advanced past tape roller 22, tape guide 80, and idler roller 28, until the leading edge of the strip of adhesive tape 53 extends partially beyond idler roller 28. Excess liner 50 may be cut by pulling liner 50 into cutting blade 96 of cutting assembly 14 and may then be discarded.

Adhesive tape 53 may be dispensed from dispenser 10 for manual application in various ways. In one method, the user pulls liner 50, thereby feeding adhesive tape 53 past peel roller 30, so that adhesive tape 53 is guided and directed by tape guide 80 around tape roller 22 by continuing to pull liner 50. The surface velocity of tape roller 22 is less than the linear speed of the adhesive tape 53 as the adhesive tape 53 is guided by tape guide 80. Adhesive tape 53 is stiff enough to be pushed over the slower tape roller 22. The combination of the slower surface velocity of the tape roller 22 and the stiffness of the adhesive tape 53 helps the adhesive tape 53 to be pushed over the tape roller 22 rather than sticking to the surface of the tape roller 22. Continued pulling of liner 50 will completely dispense adhesive tape 53 from dispenser 10 so that the user simply pulls the separated adhesive tape 53 in a direction away from dispenser 10 for application to the desired object.

Alternatively, liner 50 may be pulled so that adhesive tape 53 is fed past peel roller 30, and is guided and directed by tape guide 80 around tape roller 22 by continued pulling on liner 50. As a result, adhesive tape 53 extends partially beyond end 84 of tape guide 80 and idler roller 28, as seen in FIGS. 1 and 2. The user may then grasp and pull the leading edge of the adhesive tape 53 to dispense the tape segment. As the adhesive tape 53 is manually pulled, it is forced against tape roller 22, which drives the rotation of liner roller 24. The surface velocity of liner roller 24 is faster in this second method than liner 50, so liner roller 24 is slipping past liner 50. This helps maintain tension on liner 50 and aids in removing liner 50 at the same speed that adhesive tape 53 is being pulled by the user.

The tape belt dispenser of the present invention is advantageous in several ways. First, the user pulls liner 50 so that adhesive tape 53 extends beyond idler roller 28. Then, the user may pull on either liner 50 or adhesive tape 53 to dispense adhesive tape 53. This is a significant advantage over other known applicators or dispensers which each have particular mechanisms which require the user to pull on only the liner or the product, depending on the device. No product provides the user with an option to pull on either the liner or the adhesive tape with equal dispensing ease. The belt dispenser may be worn by the user around a waist or other portion of the body, thereby providing a more portable applicator for the user in the field. A manual belt dispenser such as in the present invention is particularly useful in situations where the user is working on the upper edges of a vehicle or other large object which requires application of the adhesive tape to hard-to-reach areas. In these situations, the manual belt dispenser provides ease of dispensing the adhesive tape where the user may be on a ladder or other device and wishes to have little movement. The user simply reaches to the loaded tape belt dispenser, which is preferably secured around his or her waist, and pulls either the extending end of the adhesive tape or the liner. Indeed, this may even be accomplished without looking at the dispenser. A portable, manual belt dispenser is typically more cost efficient for certain users than larger, more expensive applicators. In addition, the tape dispenser is to be portably provided for use in any number of ways other than on a belt, such as hand-carried, mountable on a stand, and the like.

We claim:

1. A portable dual advance dispenser for a supply of linered tape comprised of a plurality of separable strips on a release liner, the dispenser comprising a frame for supporting a supply of linered tape and a dispensing means for dispensing desired portions of the adhesive tape, said dispensing means comprising:

(a) rotatable liner dispensing means for directing a portion of the liner in a different direction from the adhesive tape;

(b) rotatable adhesive tape dispensing means adjacent the rotatable liner dispensing means for dispensing the separable adhesive tape strips;

(c) separation means proximate the rotatable adhesive tape dispensing means and the rotatable liner dispensing means for separating the liner from the adhesive tape; and (d) drive transfer means between the rotatable liner dispensing means and the rotatable adhesive tape dispensing means so that when one of the rotatable liner dispensing means and the rotatable adhesive tape dispensing means is rotated, the other of the rotatable liner dispensing means and the rotatable adhesive tape dispensing means rotates;

wherein the user may select either a first dispensing option in which the adhesive tape is pulled from the rotatable adhesive tape dispensing means and the drive transfer means causes the liner to advance through the rotatable liner dispensing means, or a second dispensing option in which the liner is pulled from the rotatable liner dispensing means and the drive transfer means causes the adhesive tape to advance through the rotatable adhesive tape dispensing means.

2. The dispenser as set forth in claim 1, wherein the rotatable adhesive tape dispensing means comprises a tape roller and a tape guide.

3. The dispenser as set forth in claim 1, wherein the rotatable liner dispensing means includes a liner roller and a pinch roller.

4. The dispenser as set forth in claim wherein the pinch roller includes resilient biasing means and an eccentric shaft.

5. The dispenser as set forth in claim 4, wherein the pinch roller is rotated to receive and thread the liner through the liner dispensing means.

6. The dispenser as set forth in claim 1, wherein the separation means includes a peel roller.

7. The dispenser as set forth in claim 1, further comprising a cutting assembly for cutting the liner.

8. The dispenser as set forth in claim 1, further comprising a belt assembly suitable for attaching the dispenser to an article of clothing so that the dispenser may be worn by a user.

9. The dispenser as set forth in claim 1, in which the frame comprises a drum assembly for holding the supply roll of linered tape on the dispenser.

10. The dispenser as set forth in claim 1, wherein the drive transfer means further comprises a differential means so that the rotatable adhesive tape dispensing means and the rotatable liner dispensing means rotate at different speeds during dispensing.

11. The dispenser as set forth in claim 10, wherein the differential means comprises a gearing mechanism.

12. A dispenser for manually dispensing a linered tape having an adhesive tape and a liner from a supply comprising:

(a) a tape support provided on the dispenser for holding the supply of linered tape;

(b) separation means provided on the dispenser for separating the linered tape into the adhesive tape and the liner;

(c) tape drive means adjacent the separation means for receiving the adhesive tape after separation, the adhesive tape extending beyond the tape drive means;

(d) guide means for guiding the adhesive tape over the tape drive means;

(e) liner advancing means adjacent the tape drive means for receiving the separated liner; and (f) interaction means between the tape drive means and the liner advancing means so that when one of the tape drive means and the liner advancing means is activated, the other of the tape drive means and the liner advancing means is activated;

such that the extending adhesive tape may be pulled by a user to dispense the adhesive tape, thereby advancing the liner through the liner advancing means, and, alternately, the liner may be grasped by the user, thereby advancing the adhesive tape over the tape drive means.

13. The dispenser of claim 12, wherein the liner advancing means comprises means for directing the liner through the dispenser and pinch roller means for receiving the liner and cooperatively engaging the liner between the means for directing the liner and the pinch roller means.

14. The dispenser of claim 13, further comprising cutting means for cutting the liner passing through the liner advancing means.

15. The dispenser of claim 12, further comprising a belt assembly suitable for attaching the dispenser to an article of clothing so that the dispenser may be positioned around the user.

16. The dispenser of claim 12, wherein the interaction means further comprises a differential means so that the rotatable adhesive tape dispensing means and the rotatable liner dispensing means rotate at different speeds during dispensing.

17. The dispenser of claim 16, wherein the differential means comprises a gearing mechanism.

18. A method for manually dispensing a linered tape from a dispenser, comprising the steps of:

a) providing a supply of linered tape, the linered tape having an adhesive tape that is mounted in separable strips on a release liner;

b) separating the adhesive tape from the liner;

c) threading the liner through a liner advancing means;

d) directing the adhesive tape to an adhesive tape dispensing member which interacts with the liner advancing means by way of a drive transfer means; and e) pulling the liner to advance the adhesive tape partially through the adhesive tape dispensing member by way of the drive transfer means to thereby extend the adhesive tape beyond the adhesive tape dispensing member.

19. The method of claim 18, further comprising the step of:

f) pulling the extending adhesive tape to dispense the adhesive tape.

20. The method of claim 18, further comprising the step of:

f) pulling the liner until the adhesive tape is completely dispensed.

* * * * *

UNITED STATES PATENT AND TRADEMARK OFFICE

CERTIFICATE OF CORRECTION

PATENT NO. : 5,482,182

DATED : January 9, 1996

INVENTOR(S) : Craig D. Thompson et al.

It is certified that error appears in the above-indentified patent and that said Letters Patent is hereby corrected as shown below:

Col. 1, line 22, "that:" should be
--that--.

Col. 9,

Claim 4, line 1, "claim" should be
--claim 3--.

Signed and Sealed this

Tenth Day of September, 1996

*Attest:*

*Attesting Officer*

BRUCE LEHMAN

*Commissioner of Patents and Trademarks*